US009877584B2

(12) United States Patent
Wu

(10) Patent No.: US 9,877,584 B2
(45) Date of Patent: Jan. 30, 2018

(54) MULTIFUNCTIONAL STORAGE DEVICE

(71) Applicant: Yao-Chuan Wu, Chiayi Hsien (TW)

(72) Inventor: Yao-Chuan Wu, Chiayi Hsien (TW)

( * ) Notice: Subject to any disclaimer, the term of this patent is extended or adjusted under 35 U.S.C. 154(b) by 94 days.

(21) Appl. No.: 14/754,269

(22) Filed: Jun. 29, 2015

(65) Prior Publication Data

US 2016/0374463 A1 Dec. 29, 2016

(51) Int. Cl.

| | |
|---|---|
| ***A47B 85/00*** | (2006.01) |
| ***A47B 97/00*** | (2006.01) |
| ***A47B 13/08*** | (2006.01) |
| *A47B 23/04* | (2006.01) |

(52) U.S. Cl.

CPC ..... *A47B 97/00* (2013.01); *A47B 13/08* (2013.01); *A47B 23/043* (2013.01); *A47B 2200/0005* (2013.01); *A47B 2200/0006* (2013.01); *A47B 2200/0085* (2013.01)

(58) Field of Classification Search

CPC ..... A47B 23/04; A47B 23/042; A47B 23/043; A47B 23/044; A47B 2021/0357; A47B 2021/0307; A47B 2021/0076; A47B 19/06; A47B 2023/047; A47B 13/16; A47B 13/003; B65D 5/52; B65D 5/5206

See application file for complete search history.

(56) References Cited

U.S. PATENT DOCUMENTS

| | | | | |
|---|---|---|---|---|
| 7,011,285 | B2 * | 3/2006 | Wang | F16M 11/10 248/673 |
| 7,073,449 | B2 * | 7/2006 | Pipkin | A47B 23/00 108/25 |
| 8,328,153 | B2 * | 12/2012 | Yang | F16M 11/10 248/370 |
| 9,198,507 | B1 * | 12/2015 | Lau | A47B 23/00 |
| 2005/0253040 | A1 * | 11/2005 | Yang | F16M 11/10 248/688 |
| 2010/0044543 | A1 * | 2/2010 | Ramey, III | A47B 23/043 248/449 |
| 2013/0313393 | A1 * | 11/2013 | Lee | A47B 23/043 248/455 |

* cited by examiner

*Primary Examiner* — Daniel J Troy
*Assistant Examiner* — Andres F Gallego
(74) *Attorney, Agent, or Firm* — C. G. Mersereau; Nikolai & Mersereau, P.A.

(57) ABSTRACT

A multifunctional storage device has a lower seat with a storage room, an upper mount pivotally connected to the lower seat, a bottom cover mounted on the lower seat, and an adjustable connecting assembly connecting the lower seat and the upper mount. The upper mount can cover the lower seat or can be opened to tilt relative to the lower seat and be held at a specific angle by the adjustable connecting assembly. When the multifunctional storage device is attached to a piece of furniture, the upper mount is flush with a platform of the furniture, such that articles can be placed on the upper mount and the platform of the furniture or be stored in the storage room. Accordingly, the furniture with the multifunctional storage device can have a basic function and multiple additional functions derived from the multifunctional storage device.

20 Claims, 9 Drawing Sheets

MULTIFUNCTIONAL STORAGE DEVICE

BACKGROUND OF THE INVENTION

1. Field of the Invention

The present invention relates to a multifunctional storage device, especially to a storage device that allows an article to have multi-functions with assistance of the storage device.

2. Description of the Prior Art(s)

Traditionally, different kinds of furniture have different usages. For instance, a desk can be used for placing articles thereon and a cabinet can be used for storing articles therein. Therefore, people can buy the furniture according to their need.

Nowadays, as residential space is decreased and for economic concern, a piece of furniture is designed to be multifunctional. Thus, a customer can buy one furniture with multiple functions. For instance, a desk with a drawer can be used for placing articles thereon and storing articles therein. With the multifunctional furniture, the residential space of the customer can be utilized more efficiently.

However, for manufacturing a conventional piece of furniture with a basic function and other additional functions, the basic function of the conventional furniture should be taken into account prior to the additional functions. Therefore, structural design of the conventional furniture is limited. A common multifunctional device cannot be used on all kinds of furniture.

To overcome the shortcomings, the present invention provides a multifunctional storage device to mitigate or obviate the aforementioned problems.

SUMMARY OF THE INVENTION

The main objective of the present invention is to provide a multifunctional storage device that has a lower seat with a storage room, an upper mount pivotally connected to the lower seat, a bottom cover mounted on a lower surface of the lower seat, and an adjustable connecting assembly connecting the lower seat and the upper mount. The upper mount can cover the lower seat. Alternatively, the upper mount can be opened to tilt relative to the lower seat and be held at a specific angle by the adjustable connecting assembly.

When the multifunctional storage device is attached to a piece of furniture, the upper mount is flush with a platform of the furniture, such that articles can be placed on the upper mount and the platform of the furniture or be stored in the storage room. Accordingly, the furniture with the multifunctional storage device can own a basic function and multiple additional functions derived from the multifunctional storage device.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
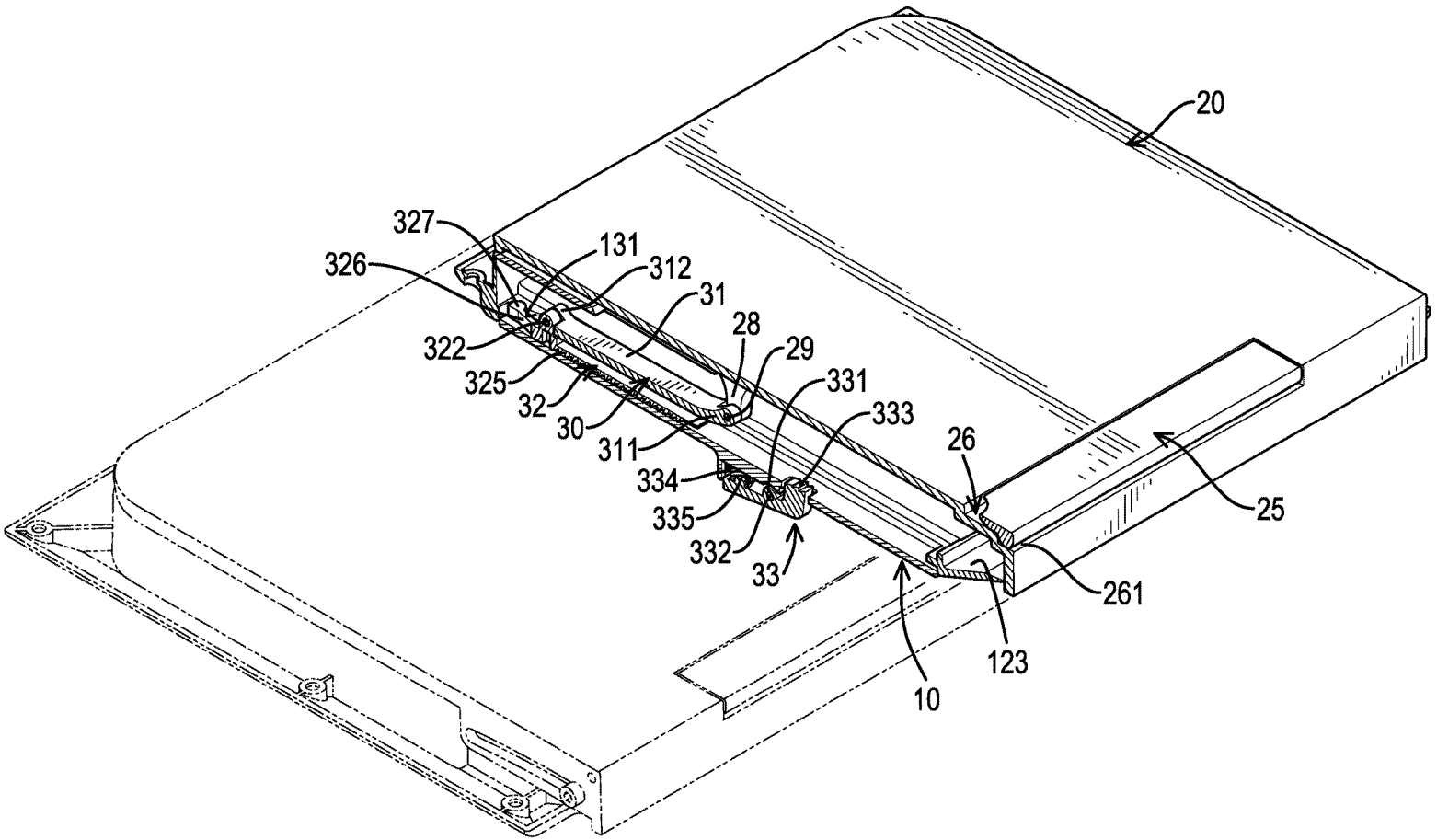
FIG. 1 is a cross-sectional perspective view of a multifunctional storage device in accordance with the present invention.
Figure 2:
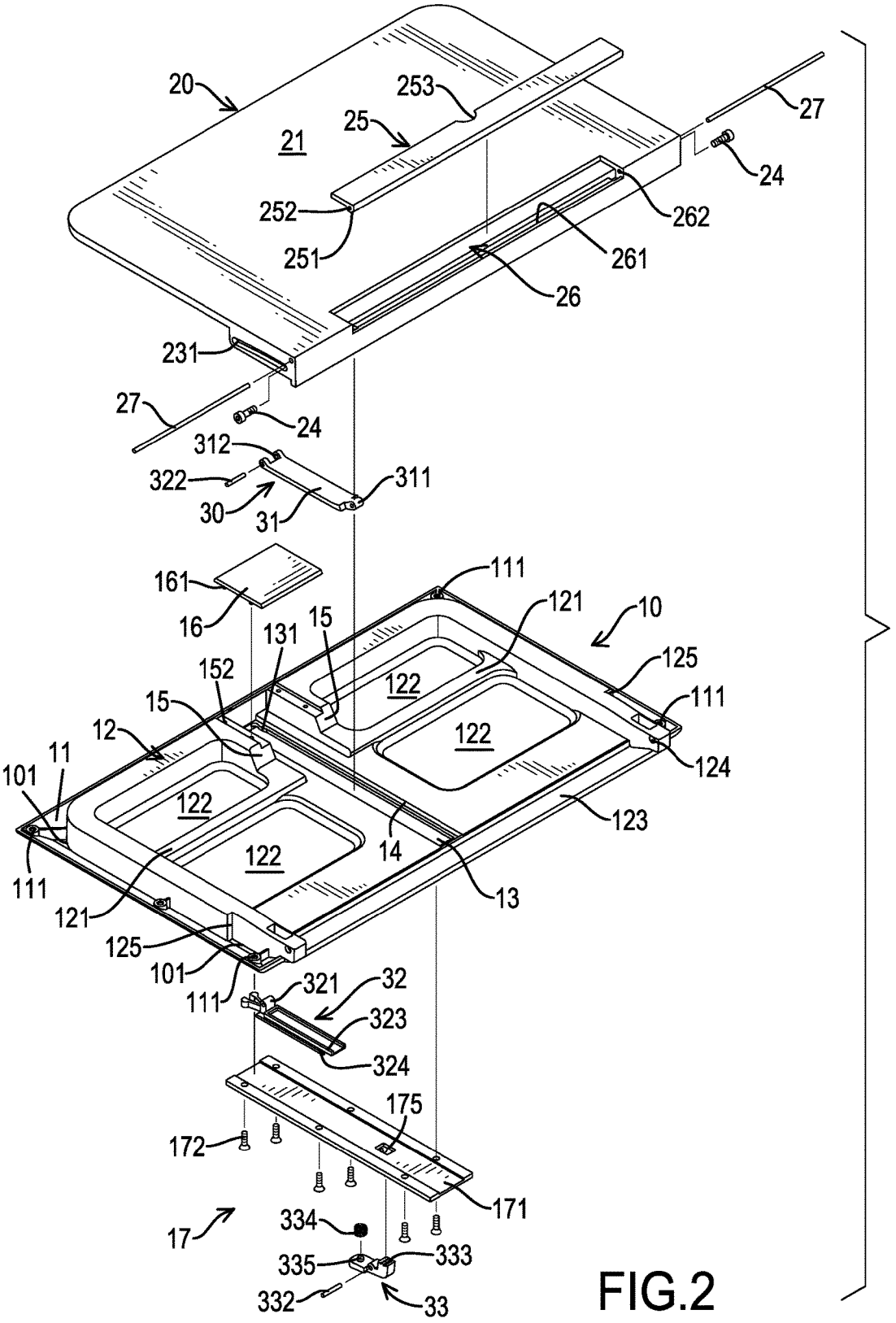
FIG. 2 is a top perspective view of the multifunctional storage device in FIG. 1.

With reference to FIGS. 1 and 2, a multifunctional storage device in accordance with the present invention comprises a lower seat 10, an upper cover 16, an upper mount 20, a rotatable cover 25, a bottom cover 17, and an adjustable connecting assembly 30.

Figure 3:
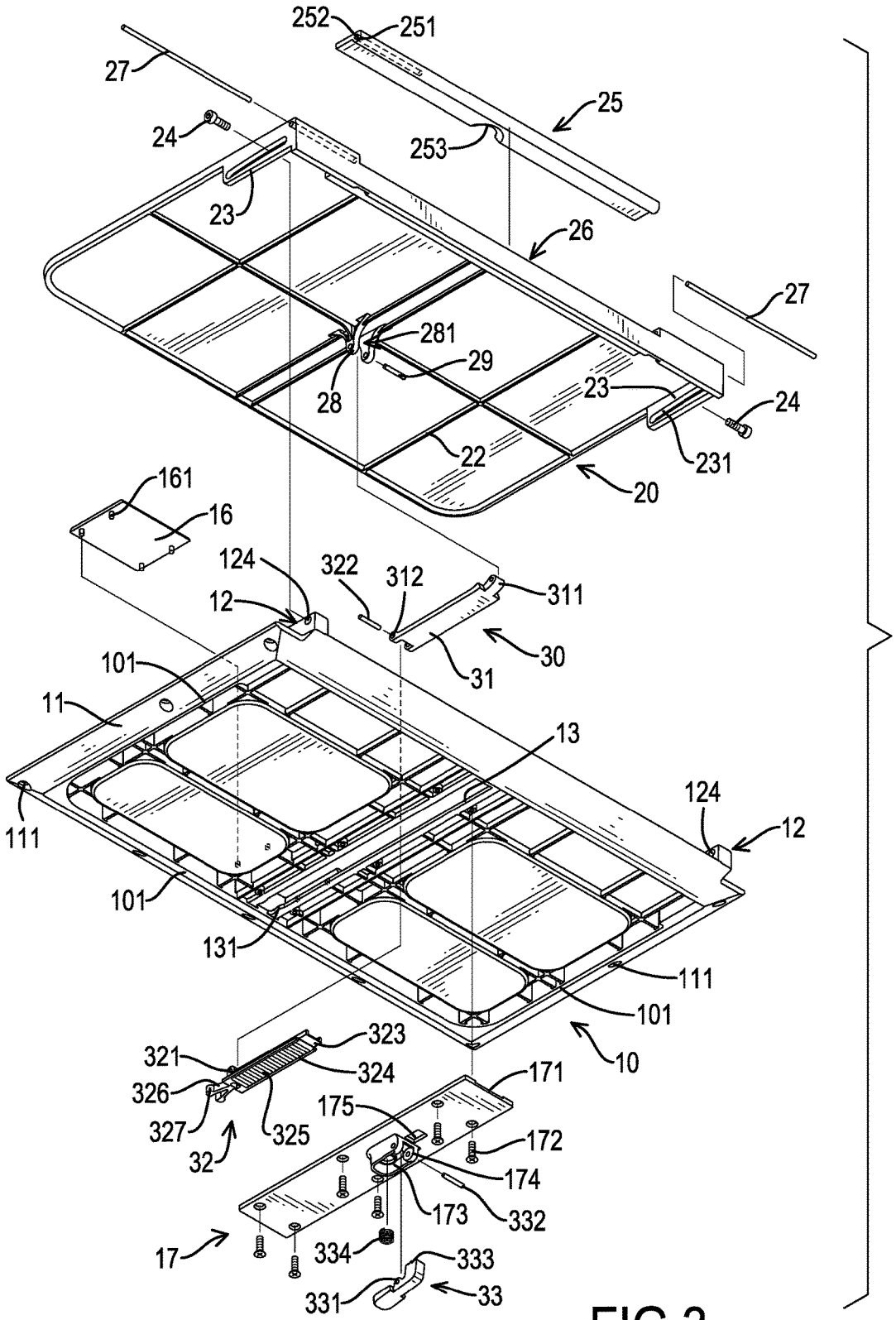
FIG. 3 is a bottom perspective view of the multifunctional storage device in FIG. 1.

With further reference to FIGS. 2 and 3, the lower seat 10 may be formed as a frame and has an upper surface, a lower surface, a periphery 101, a protruding portion 11, a frame portion 12, a sliding slot 13, two limiting side surfaces 14, and two positioning frames 15. The periphery 101 of the lower seat 10 includes two opposite side edges, a front edge, and a rear edge.

With further reference to FIG. 2, the frame portion 12 transversely protrudes up from the lower seat 10 along the two opposite side edges and the rear edge of the periphery 101 of the lower seat 10. A storage room 122 is surrounded by the frame portion 12 and can be divided by at least one partition bar 121. The frame portion 12 has front ends, two opposite outer side surfaces, a front slat 123, two stop protrusions 125, and two fastening holes 124. The front ends of the frame portion 12 corresponds in position to the front edge of the lower seat 10. The front slat 123 defines the front edge of the lower seat 10. The stop protrusions 125 are respectively formed on the outer side surfaces of the frame portion 12. The fastening holes 124 are separately formed through the front end of the frame portion 12, are disposed above the front slat 123, and align with each other. Each of the fastening holes 124 is disposed between the front ends of the frame portion 12 and a corresponding one of the stop protrusions 125.

The sliding slot 13 is formed between the two side edges of the periphery 101 of the lower seat 10 and has a front end, a rear end, and two arc convex portions 131. The front end of the sliding slot 13 extends toward the front edge of the periphery 101 of the lower seat 10. The rear end of the sliding slot 13 extends toward the rear edge of the periphery 101 of the lower seat 10. The arc convex portions 131 are oppositely formed in the sliding slot 13 and are disposed adjacent to the rear end of the sliding slot 13.

The limiting side surfaces 14 are separately formed in the upper surface of the lower seat 10 and respectively disposed beside two opposite sides of the sliding slot 13. Each of the limiting side surfaces 14 extends parallel to the sliding slot 13. In other words, two ends of each of the limiting side surfaces 14 respectively extend toward the front and rear edges of the periphery 101 of the lower seat 10. A width defined between the limiting side surfaces 14 is larger than a width defined between the opposite sides of the sliding slot 13.

The positioning frames 15 are formed on the upper surface of the lower seat 10 and are oppositely disposed beside the rear end of the sliding slot 13. Each of the positioning frames 15 has a top surface.

The upper cover 16 is securely mounted on the top surfaces of the positioning frames 15.

In the preferred embodiment, each of the positioning frames 15 further has a mounting recess 151. The mounting recess 151 is formed in the top surface of the positioning frame 15. The upper cover 16 is mounted in the mounting recesses 151 of the positioning frames 15 and is securely attached to the positioning frames 15.

Specifically, each of the positioning frames 15 further has an inner bottom and multiple engaging holes 152. The inner bottom is defined in the mounting recess 151. The engaging holes 152 are separately formed in the inner bottom of the positioning frame 15. The upper cover 16 has multiple engaging pins 161. The engaging pins 161 separately protrude from a lower surface of the upper cover 16 and respectively engage in the engaging holes 152 of the positioning frames 15. Accordingly, the upper cover 16 is securely attached to the positioning frames 15.

The upper mount 20 corresponds in shape to the lower seat 10, is mounted on the upper surface of the lower seat 10, and is pivotally connected to the lower seat 10. The upper mount 20 has two opposite sides, a front edge, a lower surface, an upper surface 21, multiple reinforcing ribs 22, two fins 23, and a pivot protrusion 28.

The lower surface of the upper mount 20 faces toward the upper surface of the lower seat 10. The upper surface 21 of the upper mount 20 is flat. The reinforcing ribs 22 are formed on the lower surface of the upper mount 20 and enhance structural strength of the upper mount 20.

The fins 23 respectively protrude down from the opposite sides of the upper mount 20. Each of the fins 23 has an elongated hole 231. The elongated hole 231 is transversely formed through the fin 23. The front edge of the periphery 101 of the lower seat 10 is disposed between the fins 23 of the upper mount 20 and is pivotally connected to the fins 23 in the elongated holes 231.

Specifically, the fins 23 are respectively disposed beside the outer side surfaces of the frame portion 12. Each of the fins 23 is disposed between the front end of the frame portion 12 and a corresponding one of the stop protrusions 125. When the upper mount 20 covers the lower seat 10, the fins 23 abut against the stop protrusions 125. The elongated holes 231 of the fins 23 respectively align with the fastening holes 124 of the frame portion 12 of the lower seat 10. Two fasteners 24 are respectively mounted through the elongated holes 231 of the upper mount 20 and are respectively fastened in the fastening holes 124 of the lower seat 10, such that the upper mount 20 is pivotally connected to the lower seat 10. Moreover, since the fasteners 24 are mounted in the elongated hole 231 of the upper mount 20, the upper mount 20 can slide relative to the lower seat 10.

The pivot protrusion 28 is formed on a center of the lower surface of the upper mount 20.

The rotatable cover 25 is pivotally connected to the front edge of the upper mount 20 via at least one pivot rod 27.

In the preferred embodiment, the upper mount 20 has an elongated recess 26, an inner bottom, two inner sidewalls, a pivot recess 261, and two pivot holes 262. The elongated recess 26 is formed in the upper surface 21 of the upper mount 20 beside the front edge of the upper mount 20. The inner bottom of the upper mount 20 is defined in the elongated recess 26. The inner sidewalls of the upper mount 20 are oppositely defined in the elongated recess 26. The pivot recess 261 is formed in the inner bottom of the upper mount 20 beside the front edge of the upper mount 20. The pivot holes 262 of the upper mount 20 are respectively formed in the inner sidewalls of the upper mount 20 and respectively extend through the opposite sides of the upper mount 20. The rotatable cover 25 is mounted in and corresponds in length to the elongated recess 26. The rotatable cover 25 has a front edge, a rear edge, a pivot portion 251, two pivot holes 252, and an indentation 253. The pivot portion 251 of the rotatable cover 25 protrudes down from the front edge of the rotatable cover 25, is mounted in the pivot recess 261 of the upper mount 20, and has two end surfaces. The pivot holes 252 of the rotatable cover 25 are respectively formed in the end surfaces of the pivot portion 251 of the rotatable cover 25 and respectively align with the pivot holes 262 of the upper mount 20. Two pivot rods 27 are mounted through the pivot holes 262 of the upper mount 20 and the pivot holes 252 of the rotatable cover 25. Each of the pivot rods 27 is mounted through one of the pivot holes 262 of the upper mount 20 and one of the pivot holes 252 of the rotatable cover 25 that align with each other. Thus, the rotatable cover 25 is pivotally connected to the upper mount 20. The indentation 253 is formed in the rear edge of the rotatable cover 25. A user can open the rotatable cover 25 with his finger inserted in the indentation 253 and driving the rotatable cover 25 to rotate.

Figure 4:
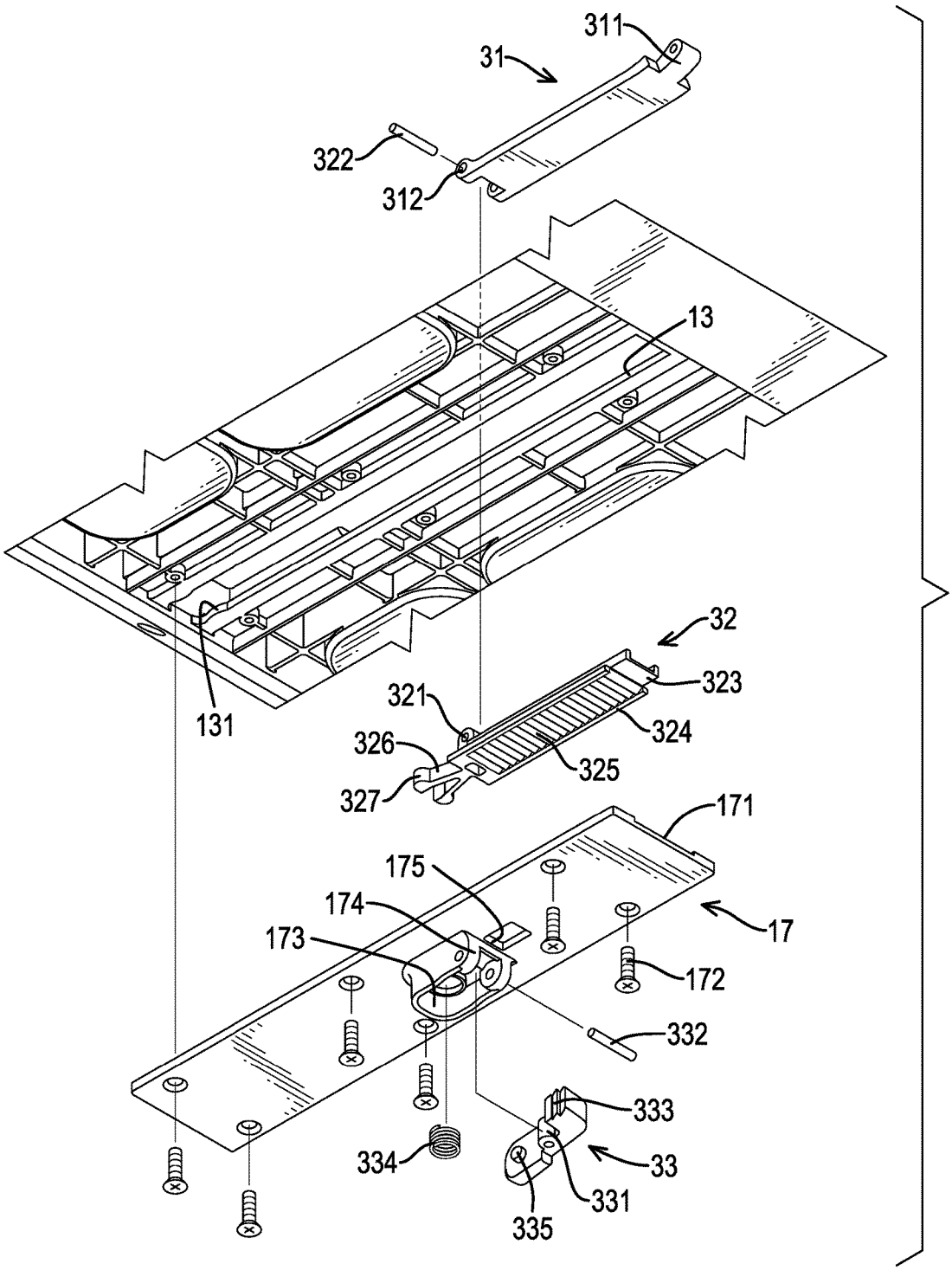
FIG. 4 is an enlarged bottom perspective view of the multifunctional storage device in FIG. 1.

With further reference to FIG. 4, the bottom cover 17 is securely mounted on the lower surface of the lower seat 10 and may be attached to the lower surface via multiple fasteners 172. The bottom cover 17 corresponds in position to the sliding slot 13 of the lower seat 10 and has an upper surface, a lower surface, a front end, a rear end, a sliding recess 171, a protruding frame 173, two ear portions 174, and a through hole 175. The upper surface of the bottom cover 17 faces the lower surface of the lower seat 10. The front end of the bottom cover 17 is positioned toward the front edge of the periphery 101 of the lower seat 10 while the rear end of the bottom cover 17 is positioned toward the rear edge of the periphery 101 of the lower seat 10. The sliding recess 171 is formed in the upper surface of the bottom cover 17 and has two ends respectively extending toward the front and rear ends of the bottom cover 17. The protruding frame 173 is hollow and is formed on the lower surface of the bottom cover 17. The ear portions 174 are oppositely forming on a front end of the protruding frame 173. Each of the ear portions 174 has a hole. The through hole 175 is formed through the bottom cover 17 and is disposed adjacent to the front end of the protruding frame 173.

Figure 5:
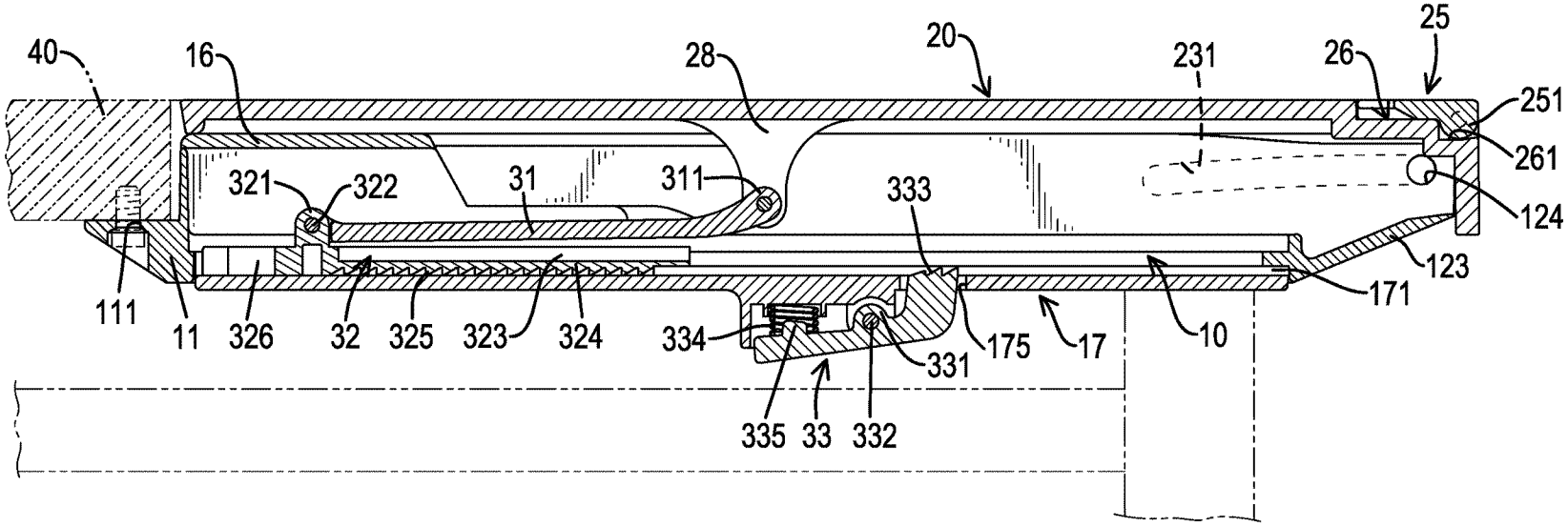
FIG. 5 is a cross-sectional side view of the multifunctional storage device in FIG. 1.

With reference to FIGS. 3, 4 and 5, the adjustable connecting assembly 30 includes a supporting panel 31, a sliding panel 32, and an engaging element 33.

The supporting panel 31 is pivotally connected to the lower surface of the upper mount 20 and has an upper end, a lower end, an upper pivot portion 311, and a lower pivot portion 312. The upper pivot portion 311 is formed on the upper end of the supporting panel 31 and is pivotally connected to the pivot protrusion 28 of the upper mount 20. The lower pivot portion 312 of the supporting panel 31 is formed on the lower end of the supporting panel 31.

In the preferred embodiment, a pivot gap 281 is formed in the pivot protrusion 28 of the upper mount 20. The upper pivot portion 311 of the supporting panel 31 is fitted in the pivot gap 281 and is pivotally connected to the pivot protrusion 28 of the upper mount 20 via a pin 29.

Figure 6:
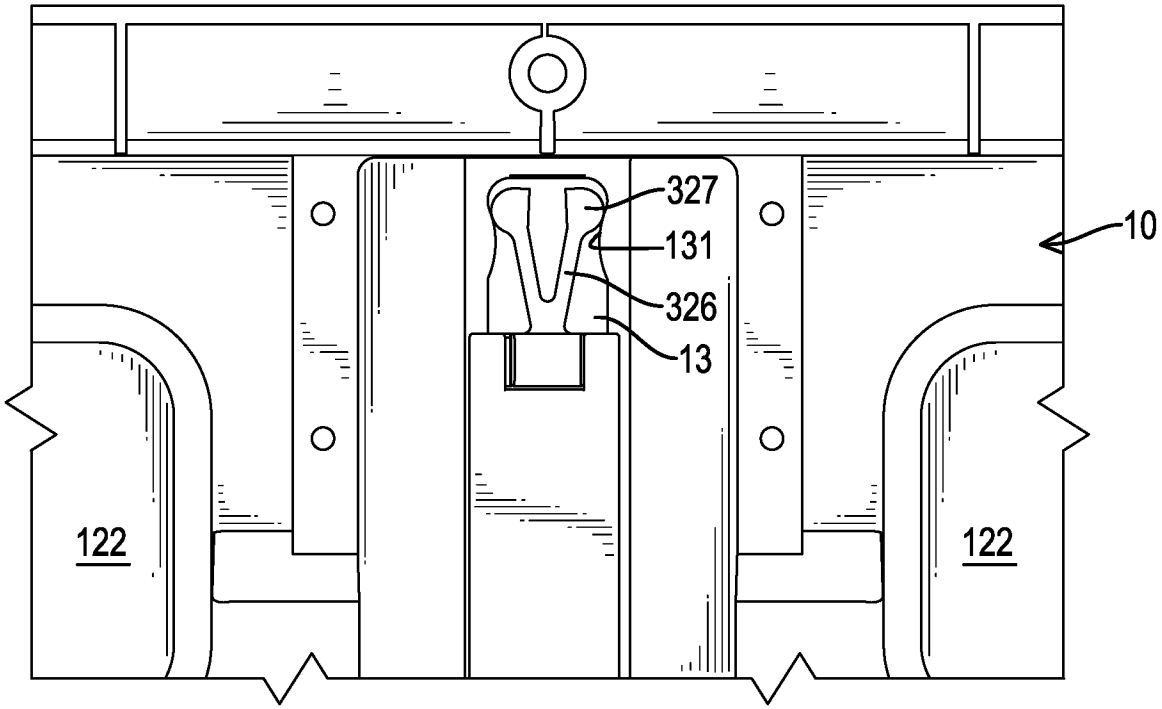
FIG. 6 is an enlarged top view of the multifunctional storage device in FIG. 1.

The sliding panel 32 is slidably mounted in the sliding slot 13 of the lower seat 10 and is pivotally connected to the supporting panel 31. The sliding panel 32 has an upper positioning portion 323, a lower limiting portion 324, a rear end, a connecting protrusion 321, multiple engaging recesses 325, and two resilient portions 326. The upper positioning portion 323 defines a width that corresponds in width to the sliding slot 13 of the lower seat 10, such that the sliding panel 32 can slide back and forth in the sliding slot 13 of the lower seat 10. The upper positioning portion 323 has a rear part. The lower limiting portion 324 is formed on a lower surface of the upper positioning portion 323, i.e. the upper positioning portion 323 is formed on an upper surface of the lower limiting portion 324. The lower limiting portion 324 is has a width that is larger relative to the upper positioning portion 323, and corresponds in width to and is slidably mounted in the sliding recess 171 of the bottom 17. The lower limiting portion 324 has a rear part. The connecting protrusion 321 is formed on the rear part of the upper positioning portion 323 of the sliding panel 32 and is pivotally connected to the lower pivot portion 312 of the supporting panel 31 via a pin 322. Thus, the upper mount 20 is pivotally connected to the sliding panel 32 via the supporting panel 31. The rear part of the lower limiting portion 324 of the sliding panel 32 and the connecting protrusion 321 of the sliding panel 32 define the rear end of the sliding panel 32. The engaging recesses 325 are formed on a lower surface of the lower limiting portion 324 of the sliding panel 32. With reference to FIG. 6, the resilient portions 326 protrude from the rear end of the sliding panel 32 and extend away from each other. Each of the resilient portions has a distal convex end 327. The distal convex ends 327 of the resilient portion 326 can be pressed to move toward each other by a force. When the force is removed, the distal convex ends 327 of the resilient portions 326 bounce back. Each of the distal convex ends 327 of the resilient portions 326 is configured to selectively engage between the rear end of the sliding slot 13 and a corresponding one of the arc convex portions 131 in the sliding slot 13 of the lower seat 10.

The engaging element 33 is pivotally mounted on the lower surface of the bottom cover 17, is pivotally mounted to the ear portions 174 of the bottom cover 17, and has a front end and at least one engaging protrusion 333. The front end of the engaging element 33 corresponds in position to the through hole 175 of the bottom cover 17 and is adapted to pivot toward the bottom cover 17 via a resilient element 334 configured to push the engaging element 33. The at least one engaging protrusion 333 is formed on the front end of the engaging element 33. When the sliding panel 32 slides to correspond in position to the through hole 175 of the bottom cover 17, the at least one engaging protrusion 333 of the engaging element 33 is configured to resiliently engage with the engaging recesses 325 of the sliding panel 32.

In the preferred embodiment, the engaging element 33 further has a rear end, a pivot portion 331, and a bump 335. The pivot portion 331 of the engaging element 33 is formed between the front and rear ends of the engaging element 33 and is pivotally connected to the ear portions 174 of the bottom cover 17 via a pivot shaft 332. The bump 335 is formed on the rear end of the engaging element 33. The resilient element 334 may be a spring, is mounted between the rear end of the engaging element 33 and the bottom cover 17, and is held on the bump 335. Thus, the resilient element 334 pushes the rear end of the engaging element 33 and the engaging element 33 pivots around the pivot portion 331 of the engaging element 33. Accordingly, the at least one engaging protrusion 333 of the engaging element 33 protrudes through the through hole 175 of the bottom cover 17 and above the upper surface of the bottom cover 17.

With reference to FIGS. 1, 5, and 6, when the upper mount 20 covers the upper surface of the lower seat 10, each of the distal convex ends 327 of the resilient portions 326 of the sliding panel 32 engages between the rear end of the sliding slot 13 and the corresponding one of the arc convex portions 131 in the sliding slot 13 of the lower seat 10, such that the sliding panel 32 is held at a specific position. Moreover, the upper surface 21 of the upper mount 20 is horizontal.

As shown in FIG. 5, when the multifunctional storage device in accordance with the present invention is attached to the furniture 40, the upper surface 21 of the upper mount 20 is flush with the platform of the furniture 40, such that articles can be placed on the upper surface 21 of the upper mount 20 and the platform of the furniture 40.

Figure 7:
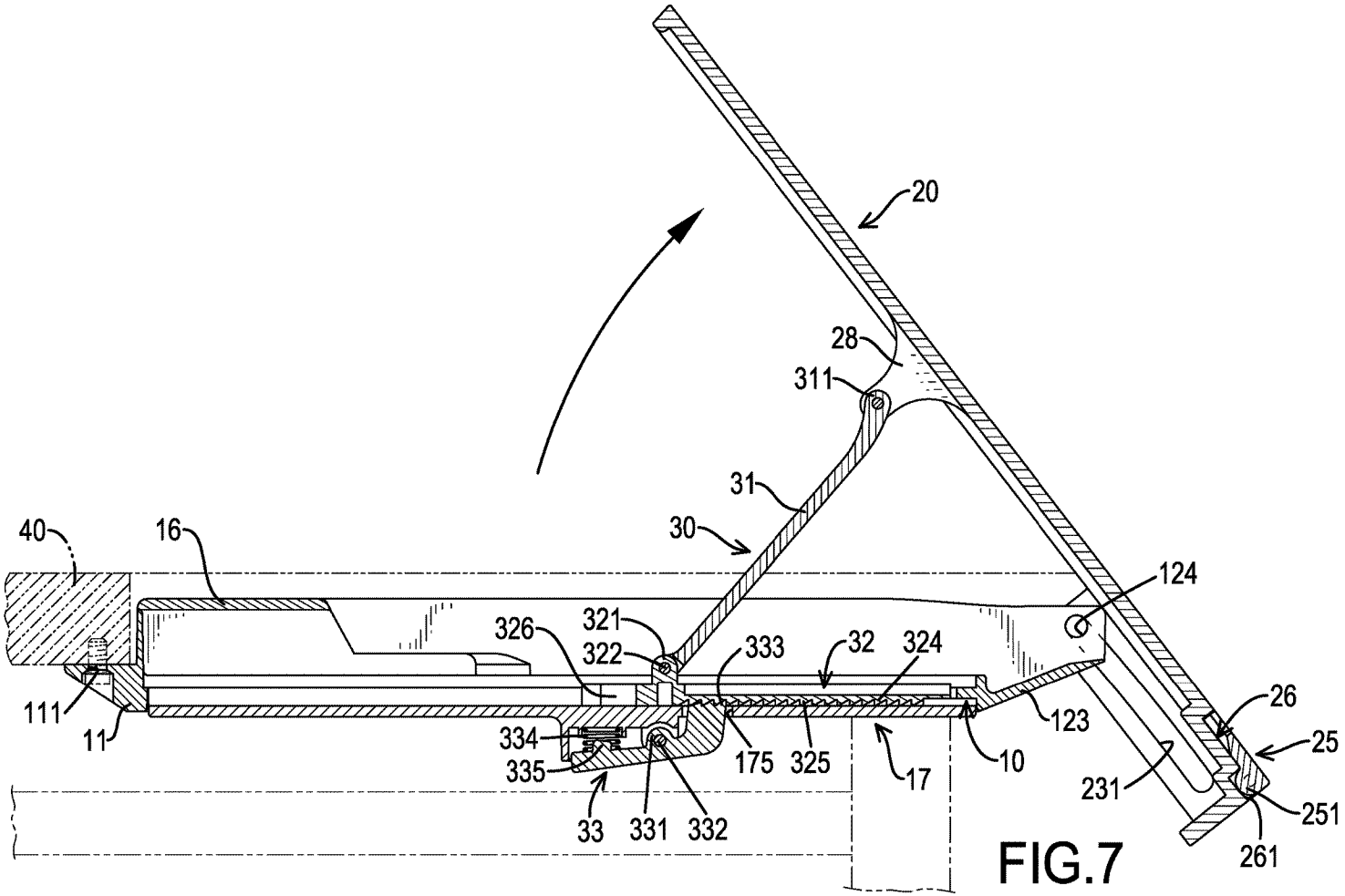
FIG. 7 is a first operational cross-sectional side view of the multifunctional storage device in FIG. 1.

With further reference to FIG. 7, for opening the upper mount 20, the upper mount 20 pivots around the fasteners 24 in the elongated hole 231 of the upper mount 20 and the fasteners 24 slide along the elongated hole 231. Moreover, the sliding panel 32 slides toward the front end of the sliding slot 13 of the lower seat 10. Thus, the storage room 122 of the lower seat 10 is exposed for putting the articles into the storage room 122. With the at least one engaging protrusion 333 of the engaging element 33 engaging with the engaging recesses 325 of the sliding panel 32, the upper mount 20 can be held at a specific angle. As engagement positions on the sliding panel 32 differ, the upper mount 20 tilts in different angles.

Figure 8:
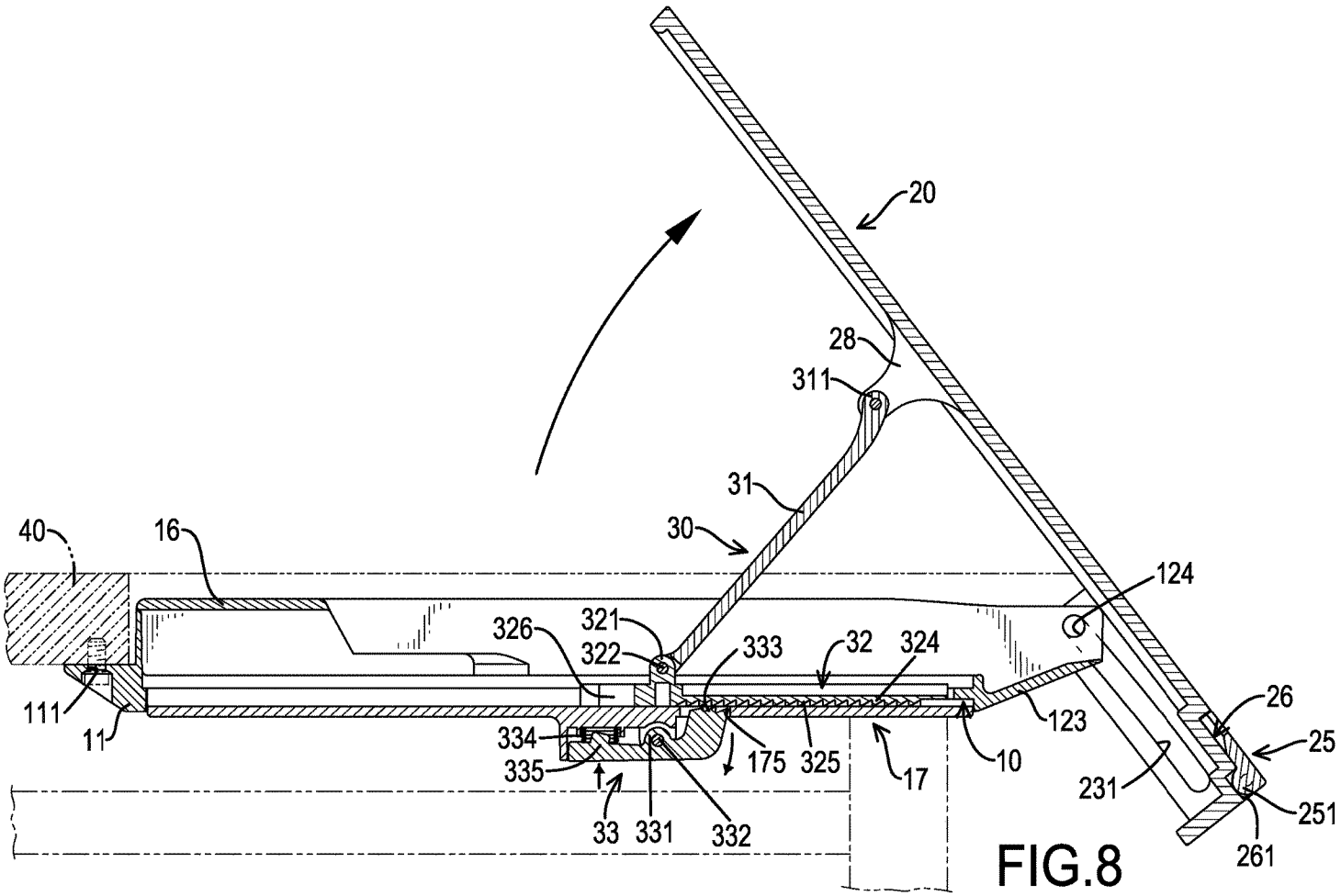
FIG. 8 is a second operational cross-sectional side view of the multifunctional storage device in FIG. 1.

With further reference to FIG. 8, as the rear end of the engaging element 33 is pressed, the at least one engaging protrusion 333 on the front end of the engaging element 33 would disengage from the engaging recesses 325 of the sliding panel 32. Thus, the upper mount 20 can pivot relative to the lower seat 10 so as to open or close relative to the lower seat 10.

Figure 9:
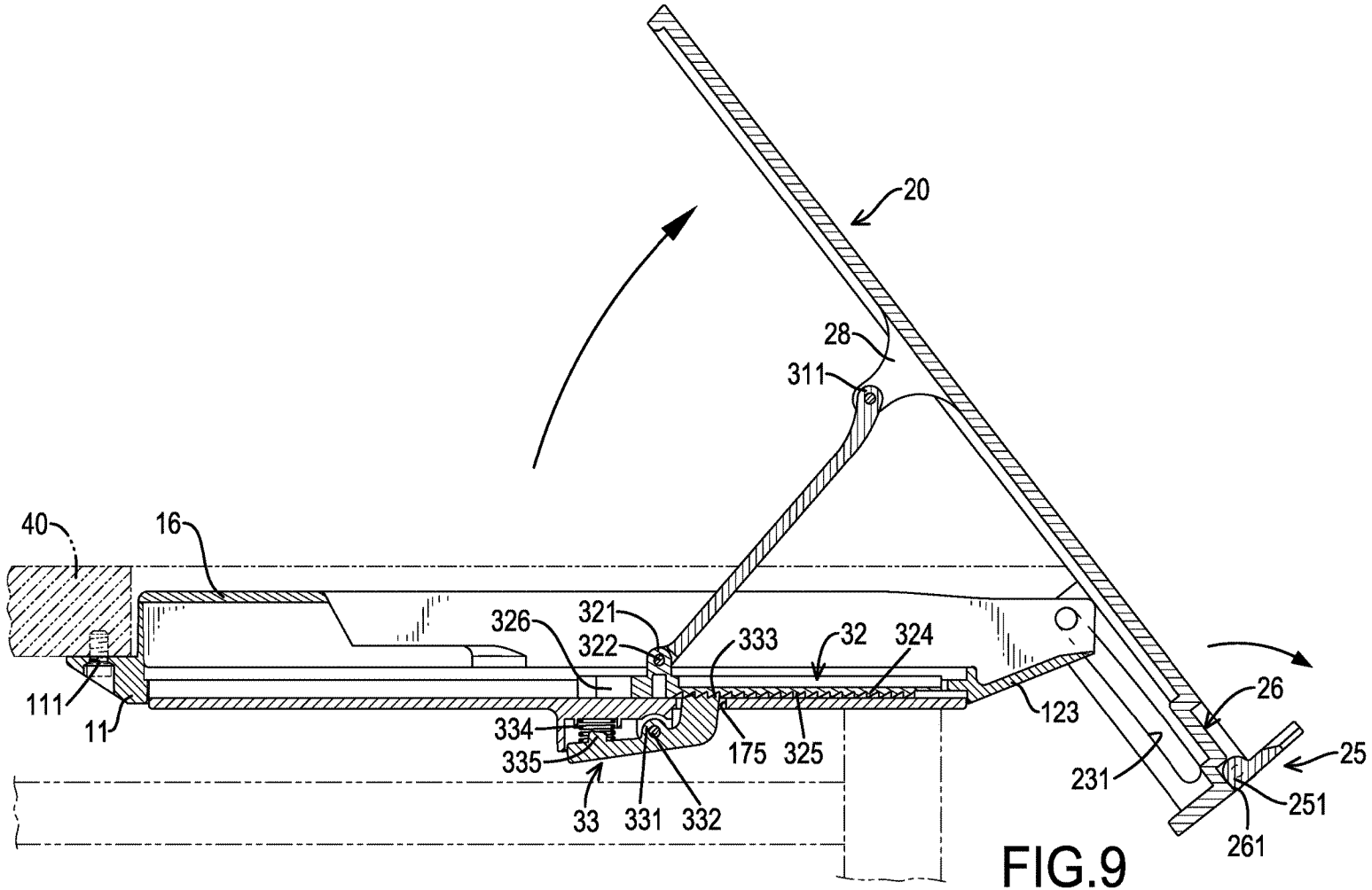
FIG. 9 is a third operational cross-sectional side view of the multifunctional storage device in FIG. 1.

With further reference to FIG. 9, when the upper mount 20 is opened relative to the lower seat 10 and a book or a tablet computer is placed on the upper mount 20, the rotatable cover 25 can be further opened relative to the upper mount 20 for supporting the book or the tablet computer. With support of the rotatable cover 25, the article placed on the upper mount 20 would not fall off from the upper mount 20.

The storage device as described can be used for storing or supporting the articles and therefore is multifunctional. Accordingly, the furniture with the multifunctional storage device can have a basic function and multiple additional functions derived from the multifunctional storage device.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A multifunctional storage device comprising:

a lower seat having an upper surface;

a lower surface;

a periphery defined by two opposite side edges and a rear edge;

a frame portion transversely protruding up from the lower seat along the two opposite side edges and the rear edge of the periphery and having front ends, wherein the front ends of the frame portion are positioned at a front edge of the lower seat;

a protruding portion protruding from the frame portion, outward from the periphery, and having multiple positioning holes, and the positioning holes formed through and separately arranged on the protruding portion;

a sliding slot formed between the two opposite side edges of the periphery of the lower seat;

a storage room surrounded by the frame portion;

an upper mount corresponding in shape to and pivotally connected to the lower seat and having two opposite sides;

a lower surface; and two fins respectively protruding down from the opposite sides of the upper mount, each of the fins having an elongated hole, and the elongated hole transversely formed through the fin;

wherein the front end of the frame portion of the lower seat is disposed between the fins of the upper mount and is pivotally connected to the fins in the elongated holes;

a bottom cover securely mounted on the lower surface of the lower seat, corresponding in position to the sliding slot of the lower seat and having a lower surface and a through hole; and an adjustable connecting assembly including a supporting panel pivotally connected to the lower surface of the upper mount;

a sliding panel slidably mounted in the sliding slot of the lower seat and pivotally connected to the supporting panel, the sliding panel having a lower limiting portion, and multiple engaging recesses formed on a lower surface of the lower limiting portion of the sliding panel; and an engaging element pivotally mounted on the lower surface of the bottom cover and having a front end corresponding in position to the through hole of the bottom cover and adapted to pivot toward the bottom cover via a resilient element configured to push the engaging element; and at least one engaging protrusion formed on the front end of the engaging element;

wherein when the sliding panel slides to correspond in position to the through hole of the bottom cover, the at least one engaging protrusion of the engaging element is configured to resiliently engage with the engaging recesses of the sliding panel.

2. The multifunctional storage device as claimed in claim 1, wherein the upper mount further has a front edge; and the multifunctional storage device further comprises a rotatable cover, and the rotatable cover is pivotally connected to the front edge of the upper mount.

3. The multifunctional storage device as claimed in claim 2, wherein the upper mount further has an upper surface;

an elongated recess formed in the upper surface of the upper mount beside the front edge of the upper mount;

an inner bottom defined in the elongated recess; and a pivot recess formed in the inner bottom of the upper mount beside the front edge of the upper mount; and the rotatable cover has a pivot portion protruding down from a front edge of the rotatable cover, mounted in the pivot recess of the upper mount, and pivotally connected to the upper mount via at least one pivot rod; and an indentation formed in a rear edge of the rotatable cover.

4. The multifunctional storage device as claimed in claim 3, wherein the upper mount further has a pivot protrusion formed on the lower surface of the upper mount;

the supporting panel of the adjustable connecting assembly has an upper pivot portion formed on an upper end of the supporting panel and pivotally connected to the pivot protrusion of the upper mount; and a lower pivot portion formed on a lower end of the supporting panel; and the sliding panel of the adjustable connecting assembly further has an upper positioning portion formed on an upper surface of the lower limiting portion and having a rear part; and a connecting protrusion formed on the rear part of the upper positioning portion of the sliding panel and pivotally connected to the lower pivot portion of the supporting panel.

5. The multifunctional storage device as claimed in claim 4, wherein the lower seat further has two limiting side surfaces, and the limiting side surfaces are separately formed in the upper surface of the lower seat and are respectively disposed beside two opposite sides of the sliding slot;

a width defined between the limiting side surfaces is larger than a width defined between the opposite sides of the sliding slot;

the upper positioning portion of the sliding panel defines a width that corresponds to the width defined between the opposite sides of the sliding slot of the lower seat; and the lower limiting portion has a width that is larger relative to the width of the upper positioning portion.

6. The multifunctional storage device as claimed in claim 4, wherein the sliding slot of the lower seat has a rear end; and two arc convex portions oppositely formed in the sliding slot and disposed adjacent to the rear end of the sliding slot;

the sliding panel further has a rear end, wherein a rear part of the lower limiting portion of the sliding panel and the connecting protrusion of the sliding panel define the rear end of the sliding panel; and two resilient portions, the resilient portions protruding from the rear end of the sliding panel and extending away from each other, each of the resilient portions having a distal convex end, the distal convex end configured to selectively engage between the rear end of the sliding slot and a corresponding one of the arc convex portions in the sliding slot of the lower seat.

7. The multifunctional storage device as claimed in claim 3, wherein the sliding slot of the lower seat has a rear end; and two arc convex portions oppositely formed in the sliding slot and disposed adjacent to the rear end of the sliding slot;

the sliding panel further has two resilient portions, the resilient portions protruding from the rear end of the sliding panel and extend away from each other, each of the resilient portions having a distal convex end, the distal convex end is configured to selectively engage between the rear end of the sliding slot and a corresponding one of the arc convex portions in the sliding slot of the lower seat.

8. The multifunctional storage device as claimed in claim 3, wherein the storage room of the lower seat is divided by at least one partition bar;

the lower seat has a front slat defining the front edge of the lower seat;

the frame portion of the lower seat has two opposite outer side surfaces;

two stop protrusions respectively formed on the outer side surfaces of the frame portion; and two fastening holes, the fastening holes separately formed through the front end of the frame portion, disposed above the front slat, aligning with each other, and aligning with the elongated holes of the fins, and each of the fastening holes disposed between the front end of the frame portion and a corresponding one of the stop protrusions;

two fasteners are respectively mounted through the elongated holes of the upper mount and are respectively fastened in the fastening holes of the lower seat;

the lower seat further has two positioning frames connected to the frame portion and formed on the upper surface of the lower seat and oppositely disposed besides a rear end of the sliding slot, and each of the positioning frames has a top surface; and the multifunctional storage device further has an upper cover securely mounted on the top surfaces of the positioning frames.

9. The multifunctional storage device as claimed in claim 2, wherein the upper mount further has a pivot protrusion formed on the lower surface of the upper mount;

the supporting panel of the adjustable connecting assembly has an upper pivot portion formed on an upper end of the supporting panel and pivotally connected to the pivot protrusion of the upper mount; and a lower pivot portion formed on a lower end of the supporting panel; and the sliding panel of the adjustable connecting assembly further has an upper positioning portion formed on an upper surface of the lower limiting portion and having a rear part; and a connecting protrusion formed on the rear part of the upper positioning portion of the sliding panel and pivotally connected to the lower pivot portion of the supporting panel.

10. The multifunctional storage device as claimed in claim 9, wherein the lower seat further has two limiting side surfaces, and the limiting side surfaces are separately formed in the upper surface of the lower seat and are respectively disposed beside two opposite sides of the sliding slot;

a width defined between the limiting side surfaces is larger than a width defined between the opposite sides of the sliding slot;

the upper positioning portion of the sliding panel defines a width that corresponds to the width defined between the opposite sides of the sliding slot of the lower seat; and the lower limiting portion has a width that is larger relative to the width of the upper positioning portion.

11. The multifunctional storage device as claimed in claim 9, wherein the sliding slot of the lower seat has a rear end; and two arc convex portions oppositely formed in the sliding slot and disposed adjacent to the rear end of the sliding slot;

the sliding panel further has a rear end, wherein a rear part of the lower limiting portion of the sliding panel and the connecting protrusion of the sliding panel define the rear end of the sliding panel; and two resilient portions, the resilient portions protruding from the rear end of the sliding panel and extending away from each other, each of the resilient portions having a distal convex end, the distal convex end configured to selectively engage between the rear end of the sliding slot and a corresponding one of the arc convex portions in the sliding slot of the lower seat.

12. The multifunctional storage device as claimed in claim 2, wherein the sliding slot of the lower seat has a rear end; and two arc convex portions oppositely formed in the sliding slot and disposed adjacent to the rear end of the sliding slot;

the sliding panel further has a rear end, wherein a rear part of the lower limiting portion of the sliding panel and a connecting protrusion of the sliding panel define the rear end of the sliding panel; and two resilient portions, the resilient portions protruding from the rear end of the sliding panel and extend away from each other, each of the resilient portions having a distal convex end, the distal convex end configured to selectively engage between the rear end of the sliding slot and a corresponding one of the arc convex portions in the sliding slot of the lower seat.

13. The multifunctional storage device as claimed in claim 2, wherein the engaging element of the adjustable connecting assembly further has a bump formed on a rear end of the engaging element; and the resilient element is mounted between the rear end of the engaging element and the bottom cover and is held on the bump.

14. The multifunctional storage device as claimed in claim 2, wherein the storage room of the lower seat is divided by at least one partition bar;

the lower seat has a front slat defining the front edge of the lower seat;

the frame portion of the lower seat has two opposite outer side surfaces;

two stop protrusions respectively formed on the outer side surfaces of the frame portion; and two fastening holes, the fastening holes separately formed through the front end of the frame portion, disposed above the front slat, aligning with each other, and aligning with the elongated holes of the fins, and each of the fastening holes disposed between the front end of the frame portion and a corresponding one of the stop protrusions;

two fasteners are respectively mounted through the elongated holes of the upper mount and are respectively fastened in the fastening holes of the lower seat;

the lower seat further has two positioning frames connected to the frame portion and formed on the upper surface of the lower seat and oppositely disposed besides a rear end of the sliding slot, and each of the positioning frames has a top surface; and the multifunctional storage device further has an upper cover securely mounted on the top surfaces of the positioning frames.

15. The multifunctional storage device as claimed in claim 1, wherein the upper mount further has a pivot protrusion formed on the lower surface of the upper mount;

the supporting panel of the adjustable connecting assembly has an upper pivot portion formed on an upper end of the supporting panel and pivotally connected to the pivot protrusion of the upper mount; and a lower pivot portion formed on a lower end of the supporting panel; and the sliding panel of the adjustable connecting assembly further has an upper positioning portion formed on an upper surface of the lower limiting portion and having a rear part; and a connecting protrusion formed on the rear part of the upper positioning portion of the sliding panel and pivotally connected to the lower pivot portion of the supporting panel.

16. The multifunctional storage device as claimed in claim 15, wherein the lower seat further has two limiting side surfaces, and the limiting side surfaces are separately formed in the upper surface of the lower seat and are respectively disposed beside two opposite sides of the sliding slot;

a width defined between the limiting side surfaces is larger than a width defined between the opposite sides of the sliding slot;

the upper positioning portion of the sliding panel defines a width that corresponds to the width defined between the opposite sides of the sliding slot of the lower seat; and the lower limiting portion has a width that is larger relative to the width of the upper positioning portion.

17. The multifunctional storage device as claimed in claim 15, wherein the sliding slot of the lower seat has a rear end; and two arc convex portions oppositely formed in the sliding slot and disposed adjacent to the rear end of the sliding slot;

the sliding panel further has a rear end, wherein a rear part of the lower limiting portion of the sliding panel and a connecting protrusion of the sliding panel define the rear end of the sliding panel; and two resilient portions, the resilient portions protruding from the rear end of the sliding panel and extending away from each other, each of the resilient portions having a distal convex end, the distal convex end configured to selectively engage between the rear end of the sliding slot and a corresponding one of the arc convex portions in the sliding slot of the lower seat.

18. The multifunctional storage device as claimed in claim 1, wherein the sliding slot of the lower seat has a rear end; and two arc convex portions oppositely formed in the sliding slot and disposed adjacent to the rear end of the sliding slot;

the sliding panel further has two resilient portions, the resilient portions protrude from a rear end of the sliding panel and extend away from each other, each of the resilient portions having a distal convex end, the distal convex end configured to selectively engage between the rear end of the sliding slot and a corresponding one of the arc convex portions in the sliding slot of the lower seat.

19. The multifunctional storage device as claimed in claim 1, wherein the engaging element of the adjustable connecting assembly further has a bump formed on a rear end of the engaging element; and the resilient element is mounted between the rear end of the engaging element and the bottom cover and is held on the bump.

20. The multifunctional storage device as claimed in claim 1, wherein the storage room of the lower seat is divided by at least one partition bar;

the lower seat has a front slat defining the front edge of the lower seat;

the frame portion of the lower seat has two opposite outer side surfaces;

two stop protrusions respectively formed on the outer side surfaces of the frame portion; and two fastening holes, the fastening holes separately formed through the front end of the frame portion, disposed above the front slat, aligning with each other, and aligning with the elongated holes of the fins, and each of the fastening holes disposed between the front end of the frame portion and a corresponding one of the stop protrusions;

two fasteners are respectively mounted through the elongated holes of the upper mount and are respectively fastened in the fastening holes of the lower seat;

the lower seat further has two positioning frames connected to the frame portion and formed on the upper surface of the lower seat and oppositely disposed besides a rear end of the sliding slot, and each of the positioning frames has a top surface; and the multifunctional storage device further has an upper cover securely mounted on the top surfaces of the positioning frames.

* * * * *